US007731174B2

(12) United States Patent
Lee et al.

(10) Patent No.: US 7,731,174 B2
(45) Date of Patent: Jun. 8, 2010

(54) PAPER PICKUP DEVICE AND IMAGE FORMING APPARATUS HAVING THE SAME

(75) Inventors: Jin-Soo Lee, Suwon-si (KR); Heung-Sup Jeong, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 517 days.

(21) Appl. No.: 11/240,576

(22) Filed: Oct. 3, 2005

(65) Prior Publication Data

US 2006/0180985 A1 Aug. 17, 2006

(30) Foreign Application Priority Data

Dec. 20, 2004 (KR) ..... 10-2004-00108810

(51) Int. Cl.
*B65H 3/06* (2006.01)

(52) U.S. Cl. ..... 271/109; 271/114; 271/115; 271/119; 271/120; 403/292; 403/293; 403/294; 403/295; 403/296; 403/298; 403/299; 403/307

(58) Field of Classification Search ..... 271/109, 271/114, 115, 119, 120; 403/292–296, 298, 403/299, 307
See application file for complete search history.

(56) References Cited

U.S. PATENT DOCUMENTS 4,207,998 A * 6/1980 Schmid ..... 226/95
4,500,224 A * 2/1985 Ewing ..... 403/343
5,040,779 A * 8/1991 Ogiri et al. ..... 271/109
5,050,854 A * 9/1991 Tajima ..... 271/122
5,085,420 A * 2/1992 Sata ..... 271/114
5,131,204 A * 7/1992 Hiendl ..... 52/848
5,141,217 A * 8/1992 Lim et al. ..... 271/10.13
5,156,388 A * 10/1992 Morita ..... 271/109
6,034,793 A * 3/2000 Park ..... 358/498
6,059,280 A * 5/2000 Yamauchi et al. ..... 271/109
6,287,042 B1 * 9/2001 Eriksson ..... 403/267
6,530,706 B2 * 3/2003 Sugimoto et al. ..... 400/625
6,616,136 B1 * 9/2003 Huang et al. ..... 271/10.13
6,824,132 B2 * 11/2004 Asai et al. ..... 271/125
7,004,671 B2 * 2/2006 Tawara et al. ..... 403/341
2002/0114642 A1 * 8/2002 Rimai et al. ..... 399/167
2003/0122298 A1 * 7/2003 Sheng et al. ..... 271/109
2004/0256787 A1 * 12/2004 Wada et al. ..... 271/109

(Continued)

FOREIGN PATENT DOCUMENTS

JP 05-069964 3/1993

(Continued)

*Primary Examiner*—Patrick Mackey
*Assistant Examiner*—Prasad V Gokhale
(74) *Attorney, Agent, or Firm*—Roylance, Abrams, Berdo & Goodman, L.L.P.

(57) ABSTRACT

Provided are a paper pickup device and an image forming apparatus having the same. The paper pickup device and the image forming apparatus having the same include a driving shaft whose end has a first combining portion and a driving shaft having a second combining portion configured to be integrally connected with the first combining portion. When the first combining portion and the second combining portion are combined with each other, the driven shaft bends and separates from the driving shaft. The first combining portion and the second combining portion may be screw-coupled to each other.

21 Claims, 12 Drawing Sheets

U.S. PATENT DOCUMENTS

2005/0236759 A1* 10/2005 Acton ..... 271/114

FOREIGN PATENT DOCUMENTS

| | | |
|---|---|---|
| JP | 08-133506 | 5/1996 |
| JP | 10-025033 | 1/1998 |
| JP | 10-087128 | 4/1998 |
| JP | 11-292320 | 10/1999 |
| KR | 2002-0011048 | 2/2002 |

* cited by examiner

PAPER PICKUP DEVICE AND IMAGE FORMING APPARATUS HAVING THE SAME

CROSS-REFERENCE TO RELATED PATENT APPLICATIONS

This application claims the benefit under 35 U.S.C. 119(a) of Korean Patent Application No. 10-2004-0108810, filed on Dec. 20, 2004, the entire disclosure of which is hereby incorporated by reference.

BACKGROUND OF THE INVENTION

1. Field of the Invention

The present invention relates to a paper pickup device and an image forming apparatus having the same. More particularly, the present invention relates to a paper pickup device which relatively easily replaces a pickup roller to prevent the pickup roller from vibrating.

2. Description of the Related Art

In general, an image forming apparatus such as a laser beam printer, an LED printer, a digital copying machine or a facsimile forms an electrostatic latent image by radiating light on a photosensitive body charged to a uniform potential. The image forming apparatus develops the electrostatic latent image by supplying a developing agent to the electrostatic latent image using a developing unit and transfers the developed image onto an intermediate transfer belt or a sheet of paper. Then, the image forming apparatus fuses the image onto the sheet of paper. Consequently, a monochrome image or a color image is formed on the sheet of paper.

Sheets of paper are stacked on a paper feeding cassette of an image forming apparatus. Each sheet of paper is picked up by a pickup roller one by one and fed along a predetermined feeding path so that an image may be formed.

FIG. 1 is a perspective view of a conventional paper pickup device. FIGS. 2 and 3 are perspective views illustrating an operation of separating a driven shaft from a driving shaft so as to replace a pickup roller.

Referring to FIGS. 1-3, a paper pickup device 20 includes a frame 10, a driving shaft 23, and a driven shaft 27. The driving shaft 23 transfers a rotating force to the driven shaft 27 and includes a rotating portion 22 to which a driving force is transferred. The driving shaft 23 further includes a sleeve 24 and a spring 25. The sleeve 24 slides along a lengthwise direction of the driving shaft 23. A groove 24*a*, to which the driven shaft 27 is coupled, is formed on one side of the sleeve 24. The spring 25 surrounds the driving shaft 23 in a lengthwise direction and elastically biases the other side of the sleeve 24 toward the driven shaft 27. The driving shaft 23 is rotatably supported by the frame 10.

The driven shaft 27 includes a rib 27*a* that will be coupled to the groove 24*a*. A pickup roller 28 is installed on the driven shaft 27. A rotating force of the driving shaft 23 is transferred to the driven shaft 27 by the rib 27*a* inserted into the groove 24*a*. When the driven shaft 27 is rotated, the rotating force is transferred to the pickup roller 28. In this case, the spring 25 elastically biases the sleeve 24 toward the driven shaft 27 so that the groove 24*a* and the rib 27*a* are coupled to each other.

The surface of the pickup roller 28 wears after a predetermined number of rotations. Thus, the pickup roller 28 loses the ability to impart a frictional force. Thus the pickup roller 28 should be replaced with another one. In order to replace the pickup roller 28, as shown in FIGS. 2 and 3, the sleeve 24 is slid along the directional arrow toward the rotating portion 22. The groove 24*a* is spaced apart from the rib 27*a* by a predetermined gap and then the driven shaft 27 separates from the driving shaft 23.

Therefore, the operation of replacing the driven shaft 27 is relatively complicated. Moreover, there is a distance between the rib 27*a* and the groove 24*a* so that the rib 27*a* can be inserted into the groove 24*a*. Due to this distance, when the rotating force is transferred to the driven shaft 27 from the driving shaft 23, the driven shaft 27 and the driving shaft 23 vibrates up and down. As such, the pickup roller 28 cannot pick up the sheet of paper smoothly.

Accordingly, there is a need for an image forming apparatus having a paper pickup device which prevents a driving shaft and a driven shaft from vibrating.

SUMMARY OF THE INVENTION

An aspect of the present invention is to solve at least the above problems and/or disadvantages and to provide at least the advantages described below. Accordingly, an aspect of the present invention is to provide a paper pickup device which prevents a driving shaft and a driven shaft from vibrating when picking up a sheet of paper and which easily separates the driven shaft from the driving shaft, and an image forming apparatus having the same.

According to an aspect of the present invention, there is provided a paper pickup device for an image forming apparatus. The paper pickup device includes a frame, a driving shaft, which is connected to a driving unit of the image forming apparatus, and is rotatably installed on the frame for movement in a predetermined direction. The driving shaft has a end with a first combining portion. The driven shaft has a pickup roller for feeding paper installed thereon. The driven shaft has an end with a second combining portion to be integrally connected with the first combining portion. The first combining portion and the second combining portion are connected with each other so that the driven shaft bends and separates from the driving shaft.

The first combining portion and the second combining portion may have a complementary configuration in which any one combining portion is inserted and combined with another combining portion. A protrusion may be formed on an outer circumference of the inserted combining portion. A combining groove is formed in a lengthwise direction of the inserted combining portion and receives the protrusion. An opening opens in the lengthwise direction of the inserted combining portion to face the combining groove to be bent and separated from the inserted combining portion may be formed in another combining portion.

The opening may include an inclined surface which inclines toward an end of the combining portion.

The device may further include a holder installed on the frame to support the driven shaft so that the driven shaft is inserted into the holder and may be freely rotated.

The combining groove and the inclined surface may be formed in the first combining portion.

The combining groove and the inclined surface may be formed in the second combining portion.

A hole may be formed on a surface of the pickup roller that contacts paper. An inner diameter of the hole increases when being pressed by a thickness of paper.

The hole may be disposed proximate to a rotational center of the pickup roller.

The surface of the pickup roller that contacts paper may be formed of a material having Poisson's ratio that ranges from about 0.1 to 0.49.

The surface of the pickup roller that contacts paper may be formed of EPDM.

According to another aspect of the present invention, there is provided an image forming apparatus having a paper pickup device feeding paper. The paper pickup device includes a driving shaft which is connected to a driving unit of the image forming apparatus. The driving shaft is rotatably installed on the frame for movement in a predetermined direction. The driving shaft has a end with a first combining portion. A driven shaft, on which a pickup roller for feeding paper is installed, has a end has with a second combining portion configured to be integrally connected with the first combining portion. The first combining portion and the second combining portion are combined with each other so that the driven shaft bends and separates from the driving shaft.

The first combining portion and the second combining portion may have a complementary configuration in which any one combining portion is inserted and combined with another combining portion. A protrusion may be formed on an outer circumference of the inserted combining portion. A combining groove may be formed in a lengthwise direction of the inserted combining portion and receives the protrusion. An opening opens in the lengthwise direction of the inserted combining portion to face the combining groove to be bent and separated from the inserted combining portion may be formed in another combining portion.

The image forming apparatus may further include a holder installed on the frame to support the driven shaft so that the driven shaft is inserted into the holder and may be freely rotated.

A hole may be formed on a surface of the pickup roller that contacts paper. The hole has an inner diameter which increases when being pressed by a thickness of paper. The hole may be disposed proximate a rotational center of the pickup roller.

According to still another aspect of the present invention, there is provided an image forming apparatus having a paper pickup device feeding paper. The paper pickup device includes a frame and a driving shaft. The driving shaft is connected to a driving unit of the image forming apparatus and rotatably installed on the frame for movement in a predetermined direction. The driving shaft has a end has with a first combining portion. A driven shaft on which a pickup roller for feeding paper is installed has a end with a second combining portion configured to be integrally connected with the first combining portion. The first combining portion and the second combining portion are screw-coupled to each other.

A hole may be formed on a surface of the pickup roller that contacts paper. The hole has an inner diameter which increases when being pressed by a thickness of paper. The hole may be disposed proximate to a rotational center of the pickup roller.

Other objects, advantages, and salient features of the invention will become apparent to those skilled in the art from the following detailed description, which, taken in conjunction with the annexed drawings, discloses preferred embodiments of the invention.

BRIEF DESCRIPTION OF THE DRAWINGS

The above and other objects, features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
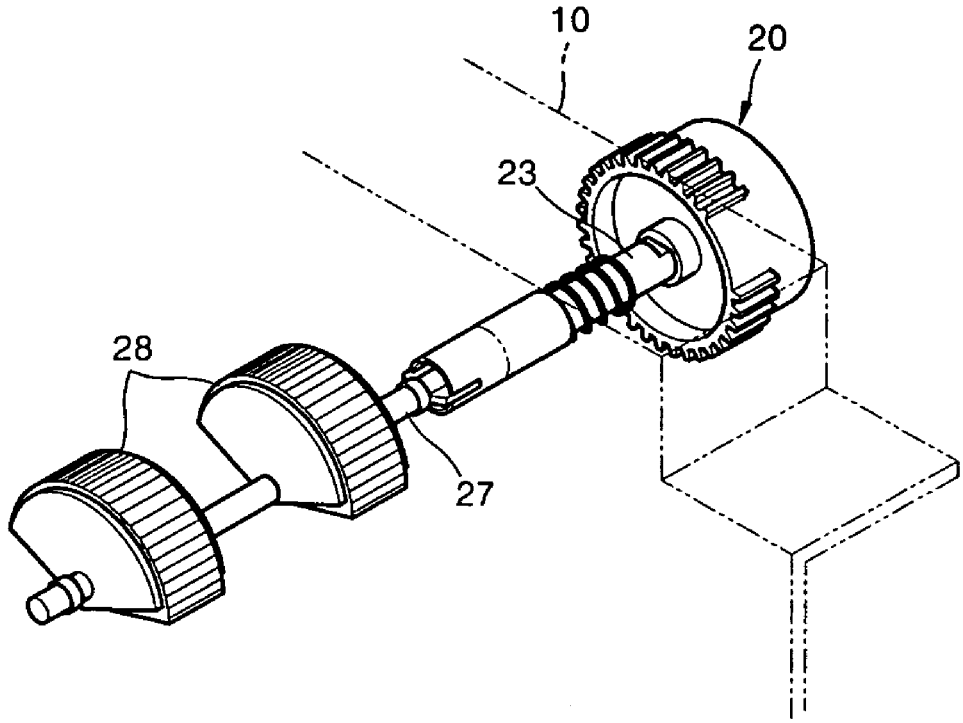
FIG. 1 (PRIOR ART)
FIG. 1 is a perspective view of a conventional paper pickup device.
Figure 2:
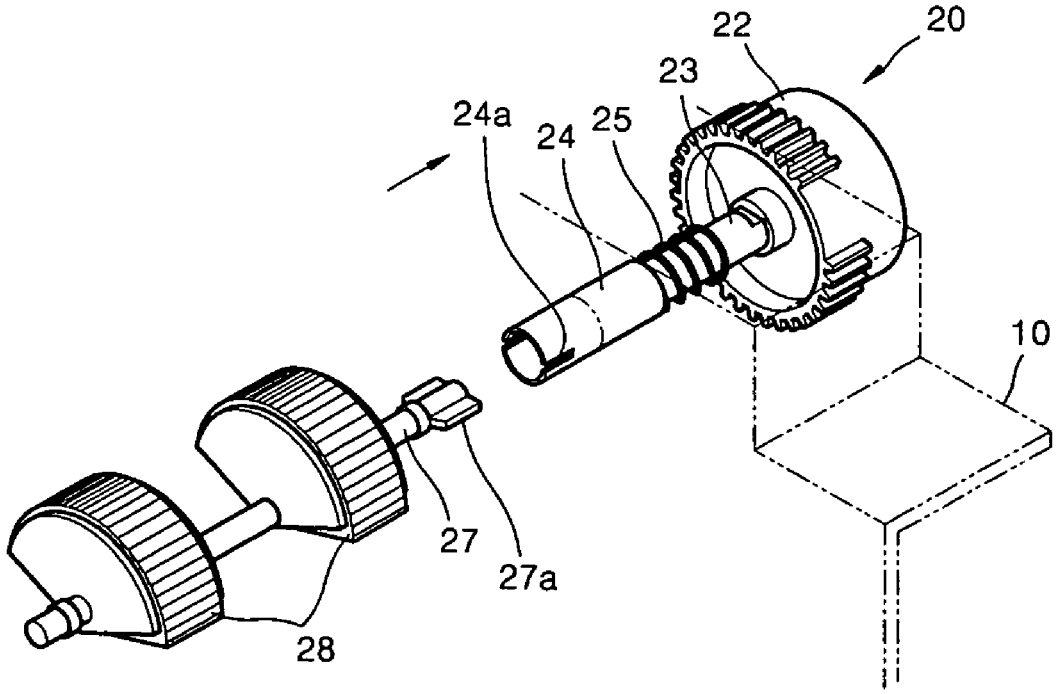
FIG. 2 (PRIOR ART)
FIGS. 2 and 3 are perspective views illustrating an operation where the driven shaft separates from a driving shaft so as to replace a pickup roller in a conventional paper pick up device.
Figure 3:
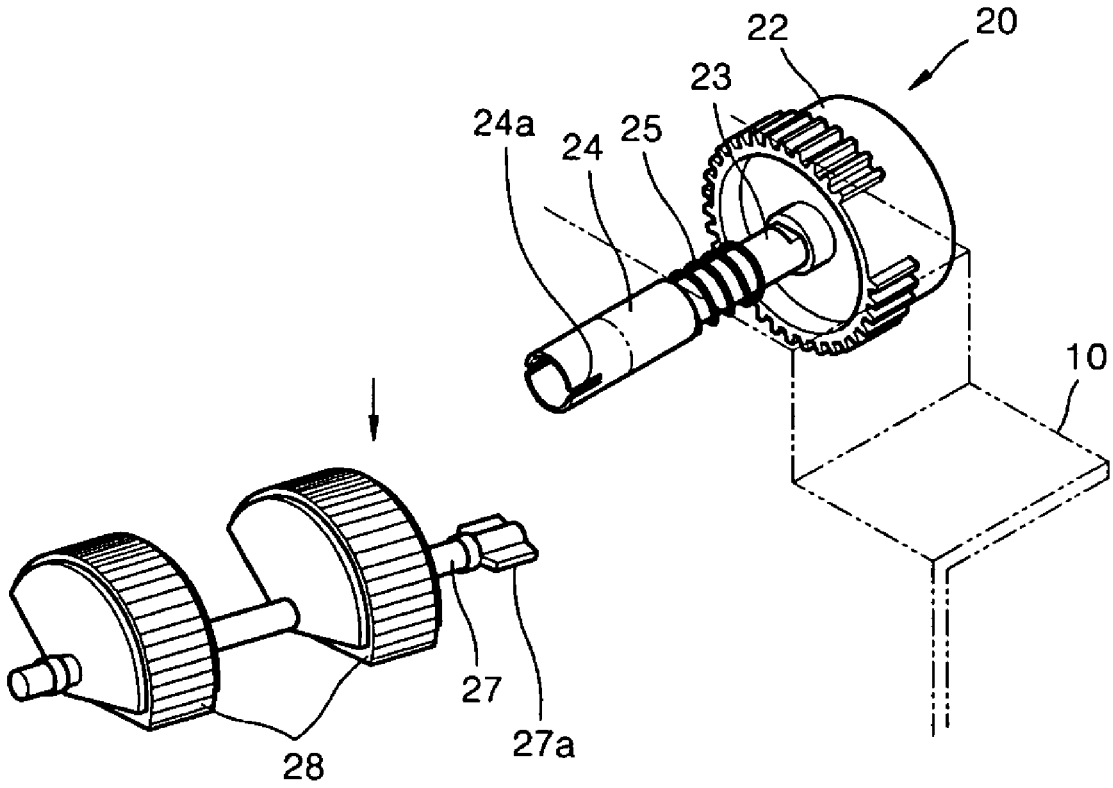
FIG. 3 (PRIOR ART)
Figure 4:
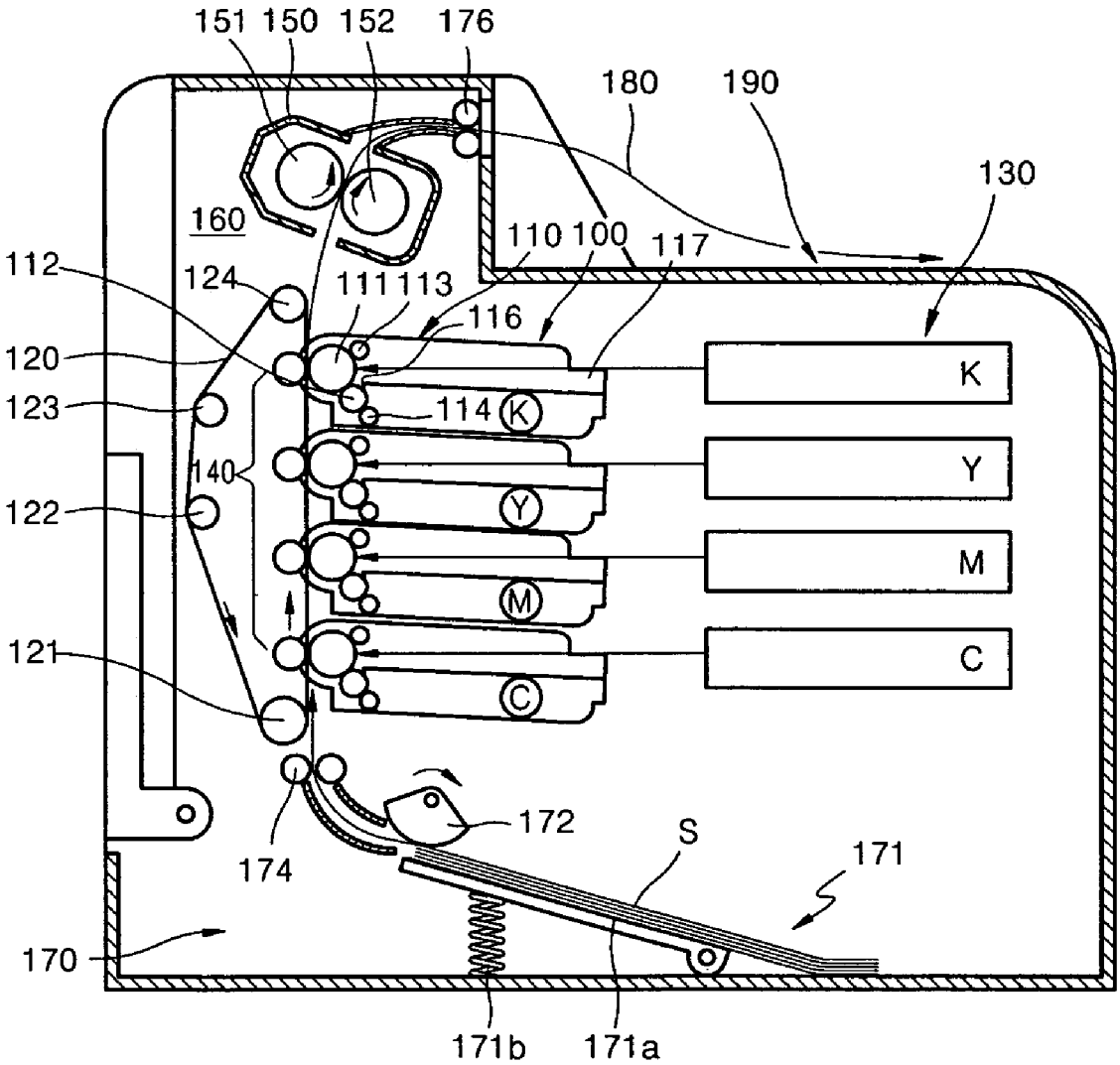
FIG. 4 is a schematic cross-sectional view of an image forming apparatus in accordance with an embodiment of the present invention.

FIG. 4 is a schematic cross-sectional view of an image forming apparatus according to an embodiment of the present invention. Referring to FIG. 4, the image forming apparatus includes a printing unit 160 to print an image onto a sheet of paper S through an electrophotographic process. Additionally, a paper feeding device 170 to feed the sheet of paper S to the printing unit 160 is shown.

The printing unit 160 includes four developing cartridges 110C, 110M, 110Y, and 110K in which toners having different colors, such as cyan (C), magenta (M), yellow (Y), and black (K), are held. The printing unit 160 also includes a transfer belt 120, exposing units 130C, 130M, 130Y, and 130K, four transfer rollers 140, and a fusing unit 150.

The transfer belt 120 is supported by a plurality of support rollers 121, 122, 123, and 124 and circulates. The transfer belt 120 in the present embodiment is installed in a vertical direction; however, other suitable arrangements and constructions maybe used. Each of the exposing units 130C, 130M, 130Y, and 130K radiates light corresponding to image information about colors such as cyan (C), magenta (M), yellow (Y), and black (K), onto a photosensitive drum 111 of each of the developing cartridges 110C, 110M, 110Y, and 110K in response to a signal input from a computer.

Each of the developing cartridges 110C, 110M, 110Y, and 110K comprises the photosensitive drum 111, a developing roller 112, a charging roller 113, a supplying roller 114, a toner layer regulating member 116, a cleaning member 118, and a storage portion 119. The photosensitive drum 111 is installed so that a portion of an outer circumference of the photosensitive drum 111 is exposed. The photosensitive drum 111 rotates in a predetermined direction and a photoconductive material layer is coated on the outer circumference of a metallic drum.

A charging bias voltage is applied to the charging roller 113 so as to charge the outer circumference of the photosensitive drum 111 to a uniform potential. Instead of the charging roller 113, other suitable arrangements and constructions may be used, such as a corona discharger (not shown).

The developing roller 112 supplies toner to the photosensitive drum 111 by adhering toners to the outer circumference of the developing roller 112. Solid powder toners are held in the developing roller 112. The developing roller 112 develops a toner image by supplying the toners to an electrostatic latent image formed on the photosensitive drum 111. A development bias voltage for supplying the toners to the photosensitive drum 111 is applied to the developing roller 112.

The supplying roller 114 adheres the toners to the developing roller 112 and is preferably installed outside the developing roller 112. Toner layer regulating member 116 regulates the amount of toner adhered to the developing roller 112 and is installed on frame 100.

Each of the developing cartridges 110C, 110M, 110Y, and 110K may further comprise an agitator (not shown) which transfers the toners held in each of the developing cartridges 110C, 110M, 110Y, and 110K toward the supplying roller 114 and/or the developing roller 112.

The developing cartridges 110C, 110M, 110Y, and 110K in the present embodiment includes an opening 117 to form a path so that light scanned by the exposing units 130C, 130M, 130Y, and 130K is radiated onto the photosensitive drum 111. An outer circumference surface exposed to the outer circumference of the photosensitive drum 111 faces the transfer belt 120.

The four transfer rollers 140 are disposed to face the photosensitive drum 111 of each of the developing cartridges 110C, 110M, 110Y, and 110K in the state where the transfer belt 120 is placed between each of the transfer rollers 140 and the photosensitive drum 111. In the present embodiment, a transfer bias voltage having a polarity opposite to that of the toner image is applied to the transfer roller 140. Thus, the toner image developed on the photosensitive drum 111 is transferred onto the sheet of paper S. The toner image is transferred onto the sheet of paper S by an electrostatic force that acts between the photosensitive drum 111 and the transfer roller 140.

The fusing unit 150 includes a heating roller 151 and a pressing roller 152. The fusing unit 150 fuses the toner image on the paper by applying heat and pressure to the toner image that has been transferred onto the sheet of paper S. The heating roller 151 acts as a heat source for permanently sticking the toner image faces the pressing roller 152 in an axial direction. The pressing roller 152 faces the heating roller 151 and fuses the toner image on the paper by applying a high pressure to the sheet of paper S.

A paper discharging roller 176 discharges the sheet of paper S on which a fusing operation has been completed to the outside an electrophotographic image forming apparatus. The sheet of paper S is discharged by the paper discharging roller 176 along a paper transfer path 180 from the printing unit 160. Then, the sheet of paper S is stacked on a stacking portion 190.

The image forming apparatus further includes a paper feeding device 170 which is disposed below the image forming apparatus and feeds the sheet of paper S to the printing unit 160. The paper feeding device 170 includes a paper feeding cassette 171 on which the sheet of paper S is stacked, a pickup roller 172 which picks up the sheet of paper S from the paper feeding cassette 171, and a double feeding prevention member 173 which prevents double feeding of the sheet of paper S. A multi-purpose feeder (MPF) can also be used to additionally feed sheets of paper S. The MPF is preferably arranged on one side of the image forming apparatus. The MPF is mainly used in feeding an OHP paper or a non-standard paper S.

Paper feeding cassette 171 is an example of a stacking unit on which the sheet of paper S is stacked. The paper feeding cassette 171 includes a knock-up plate 171*a* on which the sheet of paper S is stacked and an elastic member 171*b* which elastically biases the knock-up plate 171*a* in an upward direction.

The sheet of paper S stacked on the knock-up plate 171*a* is transferred by the pickup roller 172 one by one. The elastic member 171*b* elastically biases the sheet of paper S stacked on the knock-up plate 171*a* toward the pickup roller 172. In other words, the sheet of paper S stacked on the knock-up plate 171*a* contacts the pickup roller 172 by the elastic member 171*b* and is transferred by the pickup roller 172 outside of the paper feeding cassette 171 one by one. A paper pickup device in which the pickup roller 172 is installed will be described in detail later for purposes of clarity and conciseness.

A feed roller 174 feeds the sheet of paper S to be drawn out from the paper feeding cassette 171 by the pickup roller 172, to the printing unit 160. The sheet of paper S that has been fed in this manner passes through the printing unit 160. In this case, a toner image is transferred onto the sheet of paper S. The toner image transferred onto the sheet of paper S is fused onto the sheet of paper S by the fusing unit 150 and is discharged outside of the image forming apparatus by the paper discharging roller 176.

The operation of the image forming apparatus in accordance with embodiments of the present invention will now be described.

Color image information is created by mixing information corresponding to colors such as cyan (C), magenta (M), yellow (Y), and black (K). In the present embodiment, a toner image of each color is transferred onto the sheet of paper S and fused thereon in the order of cyan (C), magenta (M), yellow (Y), and black (K). Thus, a color image is formed.

The photosensitive drum 111 of each of the developing cartridges 110C, 110M, 110Y, and 110K is charged by the charging bias voltage applied to the charging roller 113 to a uniform electric potential. Each of the four exposing units 130C, 130M, 130Y, and 130K radiates light corresponding to image information about colors such as yellow (Y) and magenta (M) of image onto the photosensitive drum 111 of each of the developing cartridges 110C, 110M, 110Y, and 110K via the opening 117. If light is scanned by each of the developing cartridges 110C, 110M, 110Y, and 110K, only a scanned portion is selectively erased such that an electric potential is reduced. An output pattern is formed by this potential difference as an electrostatic latent image.

The toner is supplied to the developing roller 112 to which the development bias voltage is applied by the supplying roller 114. The thickness of the toner adhered to the outer circumference of the developing roller 112 becomes smaller due to a uniform thickness of the toner layer regulating unit 116. In this case, the toner is frictionally-charged by the developing roller 112 and the toner layer regulating unit 116. The toner adhered to the outer circumference of the developing roller 112 is adhered to the electrostatic latent image formed on the outer circumference of the photosensitive drum 111 so that toner images having colors such as cyan (C), magenta (M), yellow (Y), and black (K) are formed on the photosensitive drum 111 of each of the developing cartridges 110C, 110M, 110Y, and 110K.

The sheet of paper S is drawn out from the paper feeding cassette 171 by the pickup roller 172. The sheet of paper S is then fed to the printing unit 160 via a predetermined paper feeding path and discharged outside of the image forming apparatus by the paper discharging roller 176.

Specifically, the pickup roller 172 is rotated in the state where the top side of the sheet of paper S stacked on the knock-up plate 171*a* is pressed. Thus, the sheet of paper S is fed to the feed roller 174 from the knock-up plate 171*a*. The sheet of paper S fed by the pickup roller 172 is fed into the transfer belt 120 by the feed roller 174.

The sheet of paper S is attached to the surface of the transfer belt 120 by an electrostatic force and fed at the same velocity as a traveling linear velocity of the transfer belt 120. For example, the front end of the sheet of paper S reaches a transfer nip when the front end of the toner image of cyan (C) color formed on the outer circumference of the photosensitive drum 111 of the developing cartridge 110C reaches the transfer nip facing the transfer roller 140.

If a transfer bias voltage is applied to the transfer roller 140, the toner image formed on the photosensitive drum 111 is transferred onto the sheet of paper S. As the sheet of paper S is fed, toner images of colors such as magenta (M), yellow (Y), and black (K) formed on the photosensitive drums 111 of the developing cartridges 110M, 110Y, and 110K are superimposed on the sheet of paper S and transferred thereonto. Thus, a color toner image is formed on the sheet of paper S.

The toner that remains on the outer circumference of the photosensitive drum 111 after the transfer operation is completed, is removed by a cleaning member (not shown). The fusing unit 150 fuses the toner image on the paper by applying heat and pressure to the toner image formed on the paper after the transfer operation is completed. The sheet of paper S is discharged outside of the image forming apparatus by the paper discharging roller 176. The sheet of paper S discharged by the paper discharging roller 176 along the paper feeding path 180 is stacked on the stacking portion 190.

The paper pickup device in which the pickup roller 172 is installed will now be described in detail.

Figure 5:
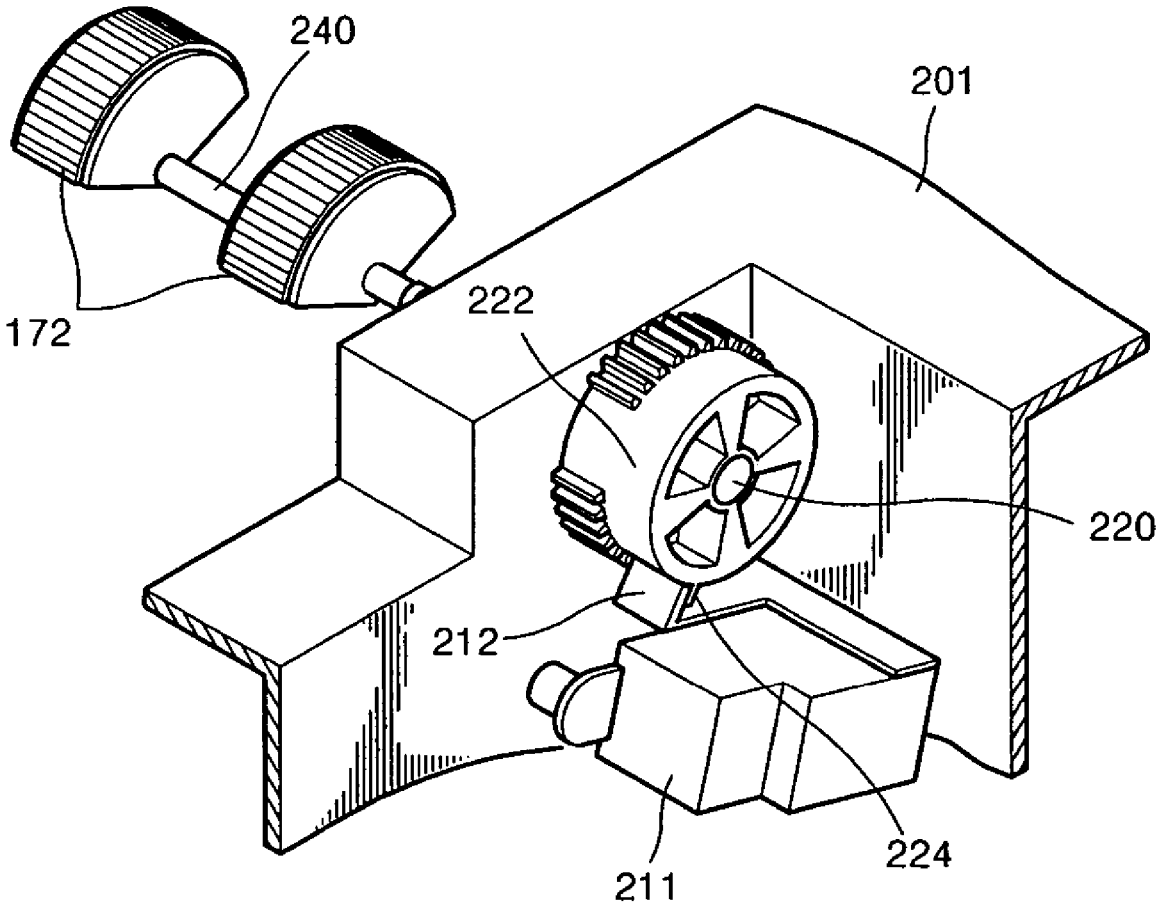
FIG. 5 is a perspective view of a paper pickup device in accordance with another embodiment of the present invention.
Figure 6:
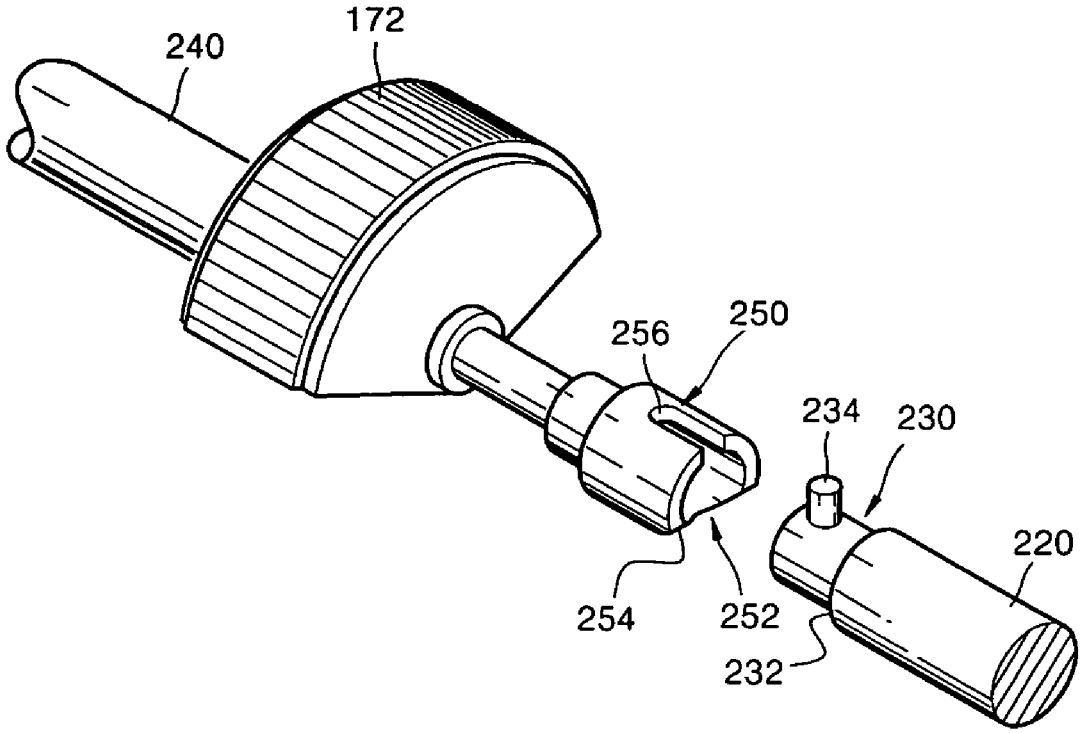
FIG. 6 is an exploded perspective view of a part of the paper pickup device shown in FIG. 5.
Figure 7:
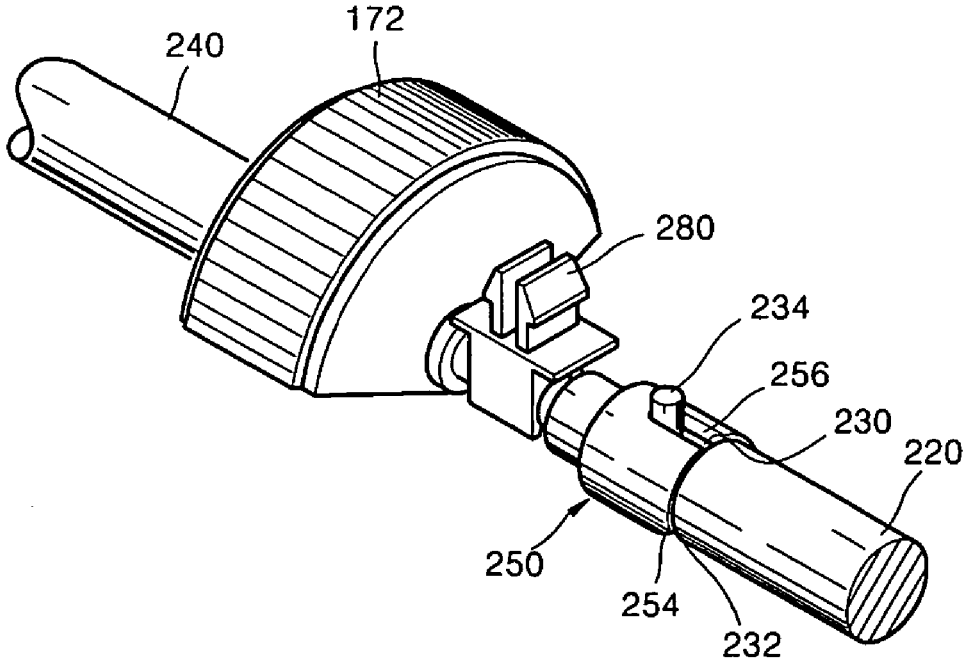
FIG. 7 is a perspective view illustrating the state in which the paper pickup device shown in FIG. 6 is combined with the image forming apparatus.

FIG. 5 is a perspective view of a paper pickup device according to an embodiment of the present invention, FIG. 6 is an exploded perspective view of a part of the paper pickup device shown in FIG. 5, and FIG. 7 is a perspective view illustrating the state where the paper pickup device shown in FIG. 6 is combined with the image forming apparatus.

Referring to FIG. 5, the paper pickup device includes a frame 201, a driving shaft 220, and a driven shaft 240.

The driving shaft 220 is connected to a driving unit (not shown) of the image forming apparatus and is installed on the frame 201 for rotation in a predetermined direction. A first combining portion 230 transmits a rotating force to the driven shaft 240 and is disposed on one end of the driving shaft 220. In addition, a rotating portion 222 to which a driving force is transmitted from a driving unit (not shown) is disposed at the other end of the driving shaft 220.

A stopper 224 is disposed on one side of the rotating portion 222. The stopper 224 protrudes from an outside of the rotating portion 222. A solenoid 211 controls the operation of an interference portion 212. Thus, the interference portion 212 interferes or does not interfere with the stopper 224. In other words, the solenoid 211 allows the stopper 212 to interfere the stopper 224 so that the rotating portion 222 is not rotated, or releases the stopper 224 so that the rotating portion 222 is rotated. Thus, if the rotating portion 222 is rotated, the driving shaft 220 rotates the driven shaft 240. Consequently, the pickup roller 172 installed on the driven shaft 240 picks up a sheet of paper S. After the pickup roller 172 picks up a sheet of paper S, the interference portion 212 interferes with the stopper 224 so that the rotating portion 122 does not rotate. If the interference portion 224 is released from the stopper 224, the pickup roller 172 picks up the next sheet of paper S. The above-described operation is repeatedly performed and the sheet of paper S stacked on the paper feeding cassette 171 is picked up.

Referring to FIGS. 6 and 7, the pickup roller 172 which feeds the sheet of paper S is installed on the driven shaft 240. A second combining portion 250 to be combined with the first combining portion 230 is disposed on one end of the driven shaft 240. The driven shaft 240 is rotated in the reverse direction as the driving shaft 220 by a rotating force transmitted from the driving shaft 220. The driven shaft 240 applies a feeding force used in feeding the sheet of paper S to the pickup roller 172 installed on the driven shaft 240.

The first combining portion 230 and the second combining portion 250 are disposed on one end of the driving shaft 220 and the driven shaft 240, respectively. The first combining portion 230 and the second combining portion 250 may be combined with each other so that the driven shaft 240 is bent and separates from the driving shaft 220. That is, if a force is applied to the driven shaft 240 perpendicular to a lengthwise direction of the driven shaft 240, the first combining portion 230 and the second combining portion 250 may be combined with each other so that the driven shaft 240 is rotated around a contact part of the second combining portion 250 and separates from the driving shaft 220.

The first combining portion 230 and the second combining portion 250 may be combined with each other so that any one combining portion thereof is inserted into another combining portion. That is, the first combining portion 230 and the second combining portion 250 are combined with each other so that one combining portion thereof is inserted into another combining portion, thereby supporting the weight of the driven shaft 240 or the driving shaft 220 with which the pickup roller 172 is combined and being rotated. In addition, in this embodiment, the case where cross-sectional shapes of the first combining portion 230 and the second combining portion 250 are circular shapes has been described. However, embodiments of the present invention are not limited to this and a variety of modifications such as cross-sectional shapes thereof may be rectangular shapes and the like are possible.

The case where the first combining portion 230 is inserted into the second combining portion 250 will now be described.

Figure 8:
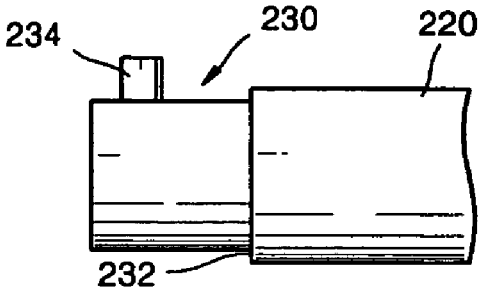
FIG. 8 is a side view of a first combining portion 230.
Figure 9:
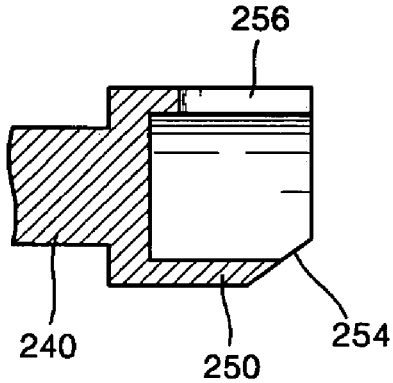
FIG. 9 is a side cross-sectional view of a second combining portion 250.
Figure 10:
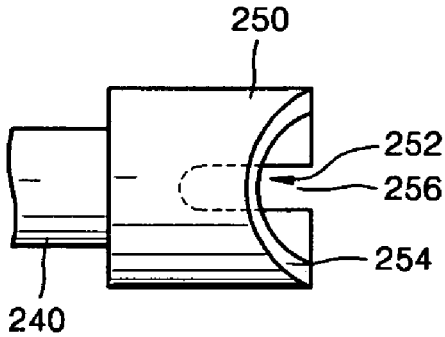
FIG. 10 is a plan view taken from a lower part of the second combining portion 250.

FIG. 8 is a side view of the first combining portion 230. FIG. 9 is a side cross-sectional view of the second combining portion 250. FIG. 10 is a plan view taken from a lower part of the second combining portion 250.

Referring to FIG. 8, an outer diameter of the first combining portion 230 is smaller than or the same as an inner diameter of the second combining portion 250. Thus, the first combining portion 230 is inserted into the second combining portion 250. A protrusion 234 to transmit a rotating force of the driving shaft 220 to the driven shaft 240 is formed on an outer circumference of the first combining portion 230. The protrusion 234 is combined with a combining groove 256 that will be described later and transmits a rotating force of the driving shaft 220 to the driven shaft 240. In addition, a stop jaw 232 is disposed on the outer circumference of the first combining portion 230. The stop jaw 232 is larger than the inner diameter of the second combining portion 250 so as to adjust an insertion depth when that the first combining portion 230 is inserted into the second combining portion 250. That is, the stop jaw 232 serves to adjust a combining location. Consequently, the first combining portion 230 and the second combining portion 250 are combined with each other in a predetermined location.

Referring to FIGS. 9 and 10, the second combining portion 250 has a substantially cylindrical shape into which the first combining portion 230 is inserted. The second combining portion 250 includes a combining groove 256 and an opening 252.

The combining groove 256 is formed in a lengthwise direction of the second combining portion 250 and the protrusion 234 is inserted into the combining groove 256. The protrusion 234 inserted into the combining groove 256 interferes a side surface of the combining groove 256. Thus, when the driving shaft 220 is rotated and transmits a rotating force of the driving shaft 220 to the driven shaft 240, the width of the combing groove 256 may be the same as the width of the protrusion 234.

Referring to FIG. 10, the opening 252 is opened in the lengthwise direction of the second combining portion 250 to face the combining groove 256. Thus, since the opening 252 is formed in the above location, the driven shaft 240 may separate from the driving shaft 220 while bending toward the opening 252.

The opening 252 may include an inclined surface 254 which inclines toward an end of the second combining portion 250. The inclined surface 254 is inclined toward the pickup roller 172 at an end of the second combining portion 250. The driven shaft 240 separates from the driving shaft 220 when the second combining portion 250 contacts the first combining portion 230 and is bent around the contact part of the second combining portion 250 to be perpendicular to the lengthwise direction of the second combining portion 250. In this case, since the inclined surface 254 is formed at an end of the second combining portion 250, the driven shaft 240 separates from the driving shaft 220 so as to not collide therewith when the second combining portion 250 is bent. In addition, by forming the opening 252 to be inclined, a wider support region of the second combining portion 250 to support the first combining portion 230 can be obtained.

Referring to FIG. 7, a paper pickup device may further include a holder 280 for supporting the driven shaft 240. One side of the holder 280 is installed on a frame 201 and supports the driven shaft 240. Thus, the driven shaft 240 can be freely rotated when inserted into the holder 280. That is, the holder 280 supports the load of the driven shaft 240 on which the pickup roller 172 is installed and prevents the driven shaft 240 from vibrating during a high-speed operation. In this embodiment, holder 280 has a smaller width of an entrance than a portion into which the driven shaft 240 is inserted and rotated. Thus, when the driven shaft 240 is inserted into the holder 280 it is not easily detached from the holder 280.

Although not shown, the paper pickup device may further include an elastic member. The elastic member is installed on the frame 201 and biases the driven shaft 240 toward the holder 280. That is, the elastic member relieves the load of the driven shaft 240 supported by the holder 280. The elastic member may be disposed on an opposite side of the driven shaft 240 in which the second combining portion 250 is installed, based on the pickup roller 172.

Figure 11:
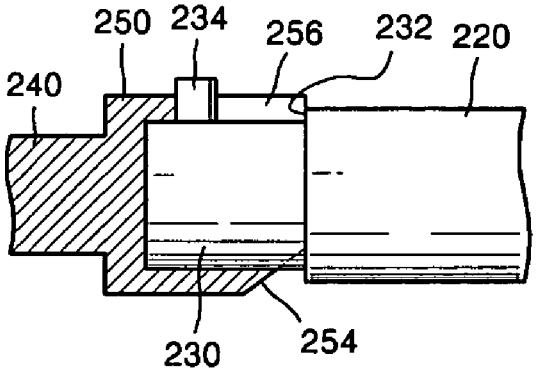
FIG. 11 is a side cross-sectional view illustrating the state in which the first combining portion 230 and the second combining portion 250 are combined with each other.
Figure 12:
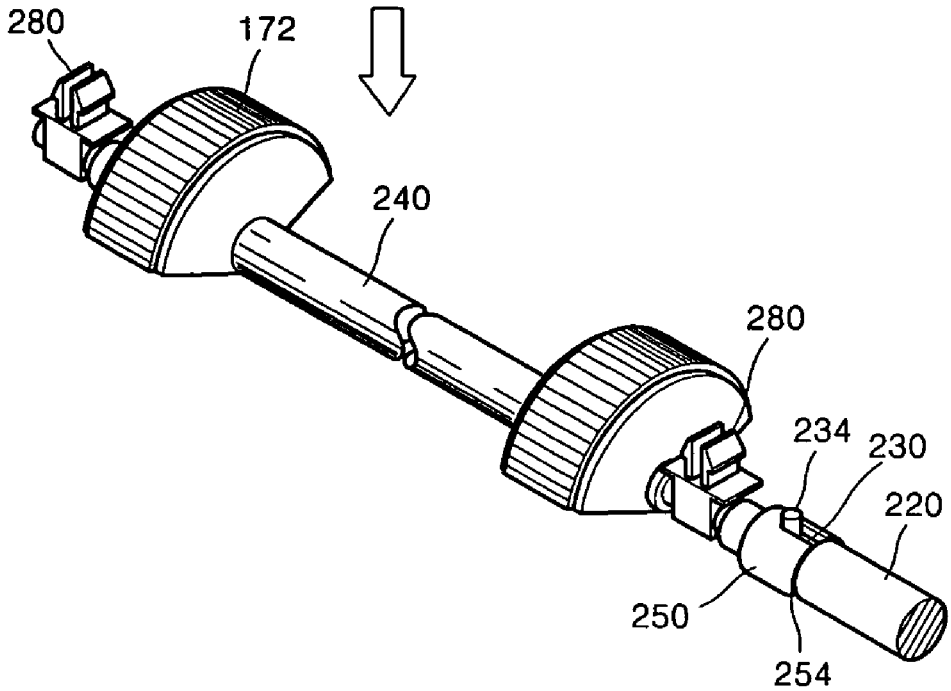
FIGS. 12 through 14 illustrate an operation in which the driven shaft 240 is bent and separated from the driving shaft 220.
Figure 13:
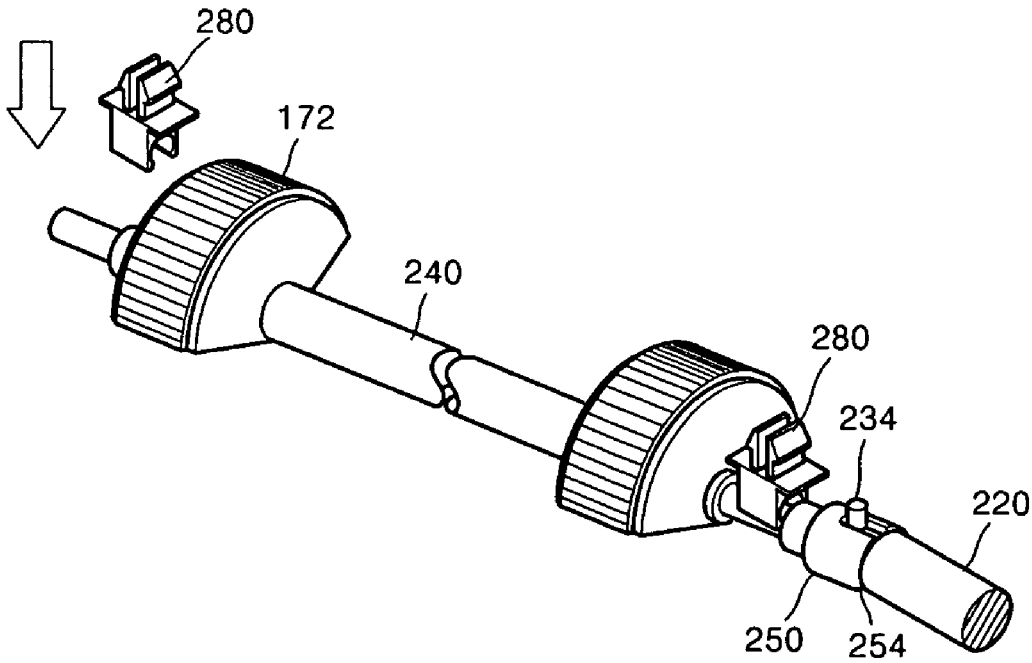
Figure 14:
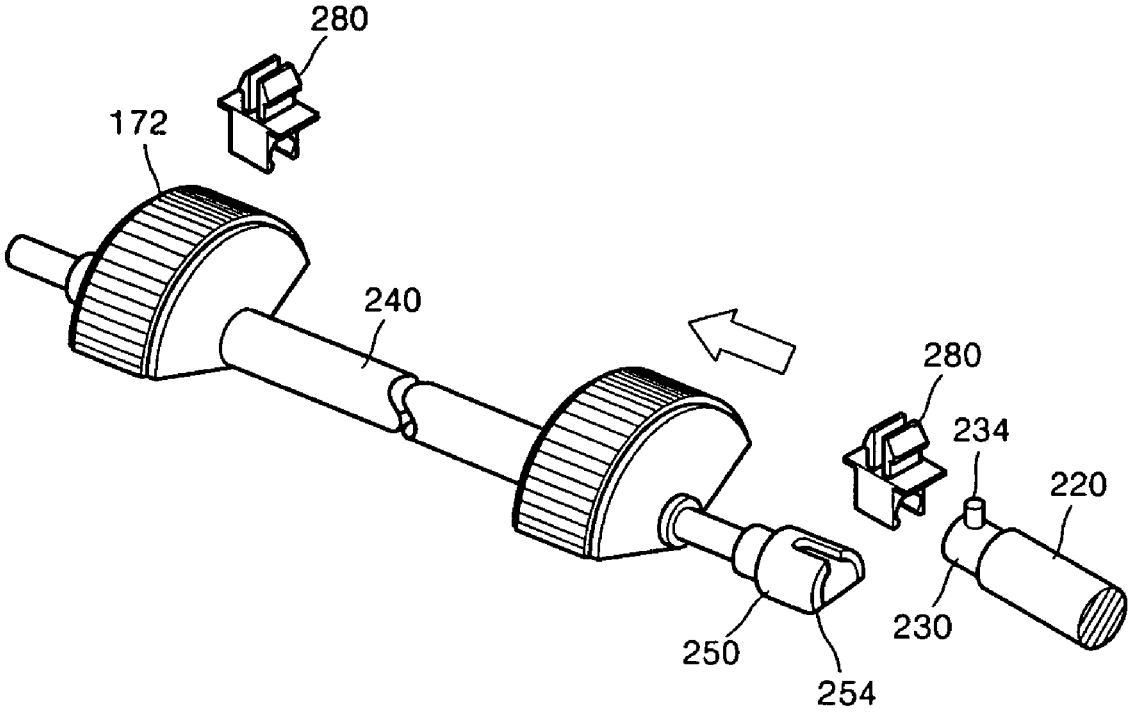

FIG. 11 is a side cross-sectional view of the state where the first combining portion 230 and the second combining portion 250 are combined with each other. FIGS. 12 through 14 illustrate an operation in which the driven shaft 240 is bends and separates from the driving shaft 220.

When the pickup roller 172 is used more than a predetermined number of times, the surface thereof is worn and a friction force applied by the pickup roller 172 is lost. Consequently, the pickup roller 172 should be replaced with another one. In order to replace the pickup roller 172, the driven shaft 240 should be separated from the driving shaft 220.

In order to replace the pickup roller 172, a force is applied to the driven shaft 240 perpendicular to a lengthwise direction of the driven shaft 240. That is, in a direction of the arrow shown in FIG. 12. Then, as shown in FIG. 13, the second combining portion 250 contacts the first combining portion 230 when the driven shaft 240 is detached from the holder 280 and bends around the contact part to be perpendicular to the lengthwise direction and separates from the first combining portion 230. In this case, since the inclined surface 254 is placed on the end of the second combining portion 250, the second combining portion 250 can be separated from the first combining portion 230 so as to not collide therewith when the second combining portion 250 is bent. When the first combining portion 230 and the second combining portion 250 are separated from each other in this way, as shown in FIG. 14, the driven shaft 240 separates from the driving shaft 220 and is then replaced with the driven shaft 240 on which a new pickup roller 172 is installed. An operation of combining the new driven shaft 240 is performed in reverse of the above-described separation operation.

In this embodiment, the case where the first combining portion 230 is inserted into and combined with the second combining portion 250 has been described. However, embodiments of the present invention are not limited to this and a variety of modifications such as the case where the second combining portion 250 can be inserted into and combined with the first combing portion 230 are possible. In this case, the second combining portion 250 has the same structure as the above-described first combining portion 230, and the first combining portion 230 also has the same structure as the above-described second combining portion 250.

Figure 15:
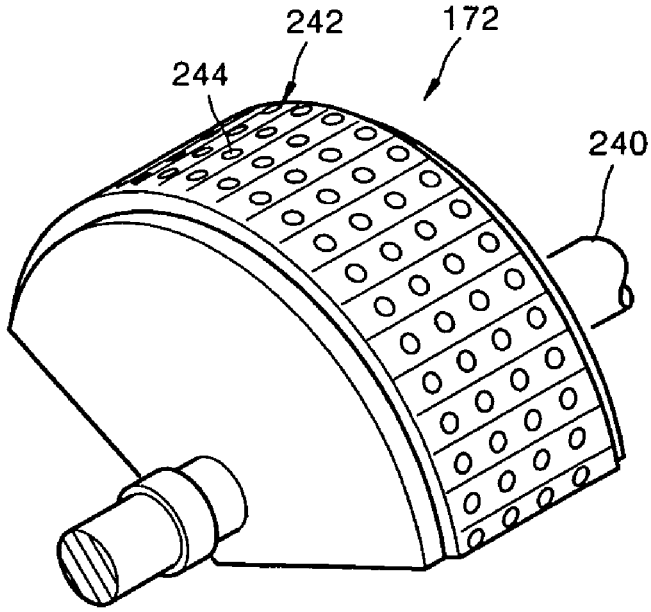
FIG. 15 is a perspective view of the pickup roller 172 installed on the driven shaft 240.
Figure 16:
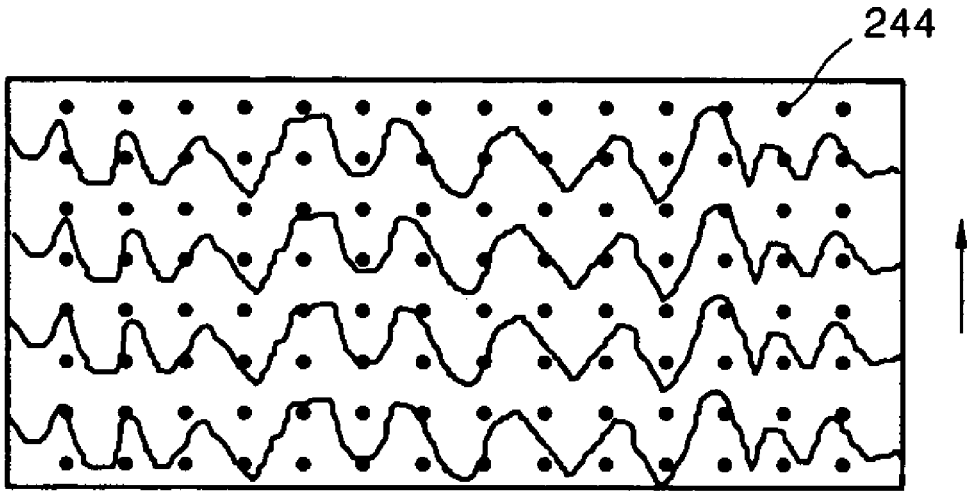
FIGS. 16 and 17 are plan views of a surface pattern of the pickup roller 172 that contacts the sheet of paper S in accordance with still another embodiment of the present invention.
Figure 17:
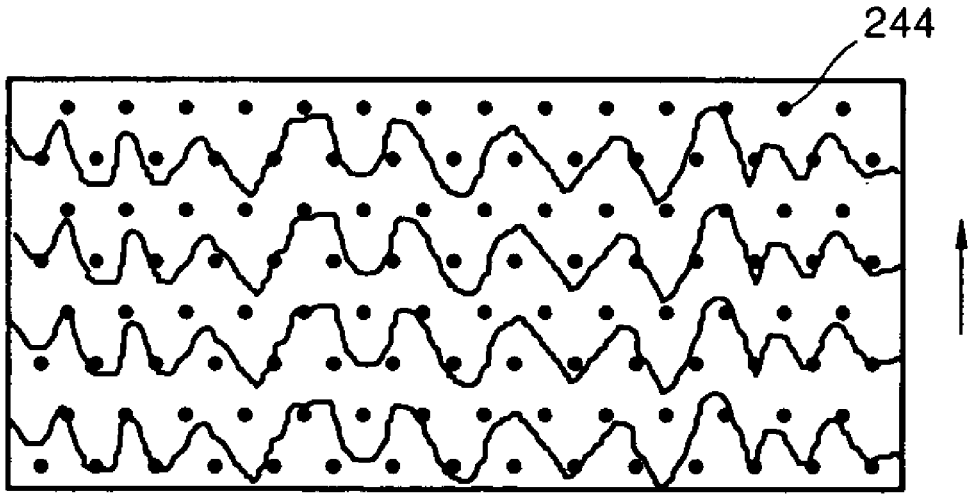
Figure 18:
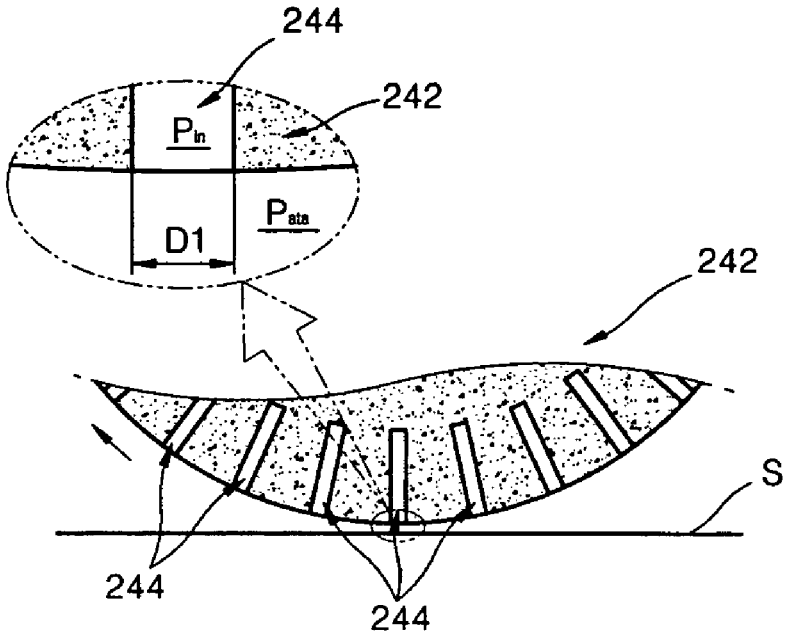
FIG. 18 is an enlarged cross-sectional view of a part of the pickup roller 172 shown in FIG. 15.
Figure 19:
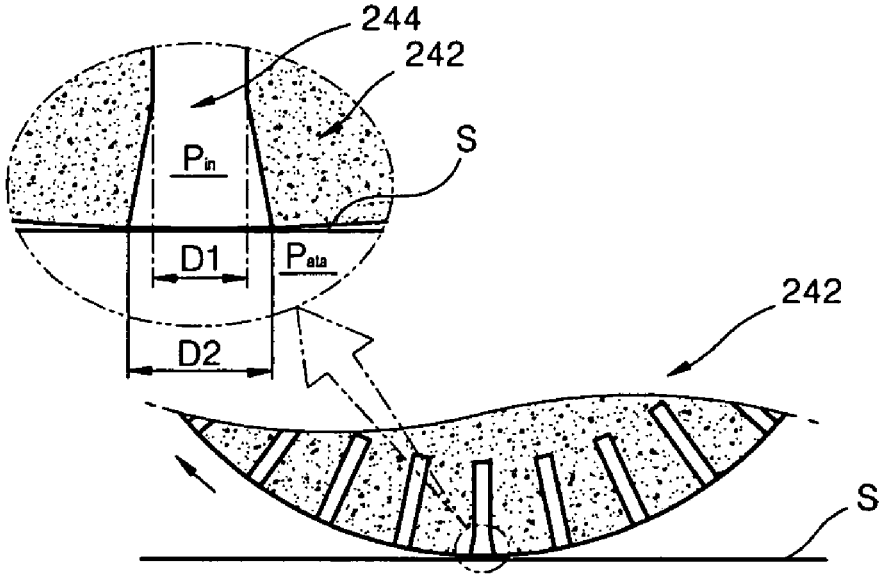
FIG. 19 is an enlarged cross-sectional view of a part of the pickup roller 172 shown in FIG. 15 and illustrates the state in which the pickup roller 172 contacts the sheet of paper S.

FIG. 15 is a perspective view of the pickup roller 172 installed on the driven shaft 240. FIGS. 16-17 are plan views of a surface pattern of the pickup roller 172 that contacts the sheet of paper S according to another embodiment of the present invention. FIGS. 18-19 are enlarged cross-sectional views of a part of the pickup roller 172 shown in FIG. 15 and illustrates the state before the pickup roller 172 contacts the sheet of paper S.

The pickup roller 172 is rotated in the state where a top side of the sheet of paper S is pressed, thereby feeding the sheet of paper S.

Referring to FIG. 15, a plurality of holes 244 are formed on a contact surface 242 of the pickup roller 172 that contacts the sheet of paper S. Thus, pickup performance may be improved. In addition, also in order to improve the pickup performance, each of the plurality of holes 244 may be formed in various patterns. For example, as shown in FIGS. 16 and 17, the holes 244 may be formed in a regular pattern over the surface of the pickup roller 172. Specifically, referring to FIG. 16, the holes 244 are formed in a vertical direction parallel to a feeding direction of the sheet of paper S indicated by the arrow. Referring to FIG. 17, the holes 244 are formed in a vertical direction alternately to the feeding direction of the sheet of paper S indicated by the arrow. Unlike in FIGS. 16 and 17, the holes 244 may be formed in an irregular pattern over the surface of the pickup roller 172. In addition, the pickup roller 172 may have a wave surface pattern, so as to increase a friction force on its surface.

Referring to FIG. 18, each of the holes 244 extend in a direction of the driven shaft 240 which is a rotational center of the pickup roller 172. In the state where the sheet of paper S stacked on the knock-up plate 171*a* does not contact the pickup roller 172, the pickup roller 172 and the holes 244 formed on the surface of the pickup roller 172 keep their original shapes, and a pressure $P_{in}$ inside of the holes 244 and an external pressure $P_{atm}$ are kept at the same level. When a printing operation starts, the sheet of paper S contacts a lower end of the pickup roller 172, as shown in FIG. 19. The lower end of the pickup roller 172 is pressed by the sheet of paper S and is deformed. The inner diameter of the holes 244 increases from D1 to D2. Since the above change occurs instantaneously, the change can be assumed as an adiabatic change procedure. An increase in the inner diameter of the holes 244 causes an increase in volume inside of the holes 244. Thus, the pressure $P_{in}$ inside of the holes 244 will become smaller than the external pressure $P_{atm}$ according to a well-known thermodynamic rule, and due to the difference in pressure, a force in which the sheet of paper S will be absorbed to the pickup roller 172 will be generated.

The pickup roller 172 may be formed of a material having Poisson's ratio that ranges from about 0.1 to 0.49. Poisson's ratio is the ratio of horizontal deformation to vertical deformation created when a stress is applied to a material. If Poisson's ratio is smaller than 0.1, the pickup roller 172 becomes hard and a change of the inner diameter of the holes 244 is small. If Poisson's ratio is larger than 0.49, the pickup roller 172 becomes soft and may be deformed in a direction in which the inner diameter of the holes 244 is reduced.

The pickup roller 172 may be formed of EPDM, so as to increase a friction force with the sheet of paper S. In other words, the surface of the pickup roller 172 that contacts the sheet of paper S may be formed of EPDM. NR-based, NBR-based, urethane-based or silicon-based rubber instead of EPDM may be used for the pickup roller 172.

A paper pickup device according to another embodiment of the present invention will now be described with reference to the attached drawings. For an purposes of explanatory convenience, elements having the same functions and effects as the previous embodiment refer to the same reference numerals. In addition, the entire structure and operation of the paper pickup device are as described above, and thus, a detailed description thereof will be omitted.

Figure 20:
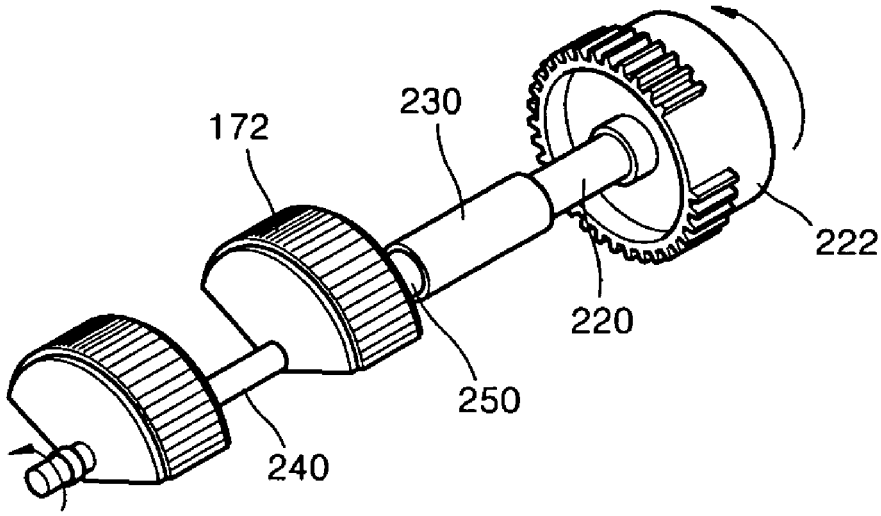
FIG. 20 is a perspective view of a paper pickup device according to yet another embodiment of the present invention.
Figure 21:
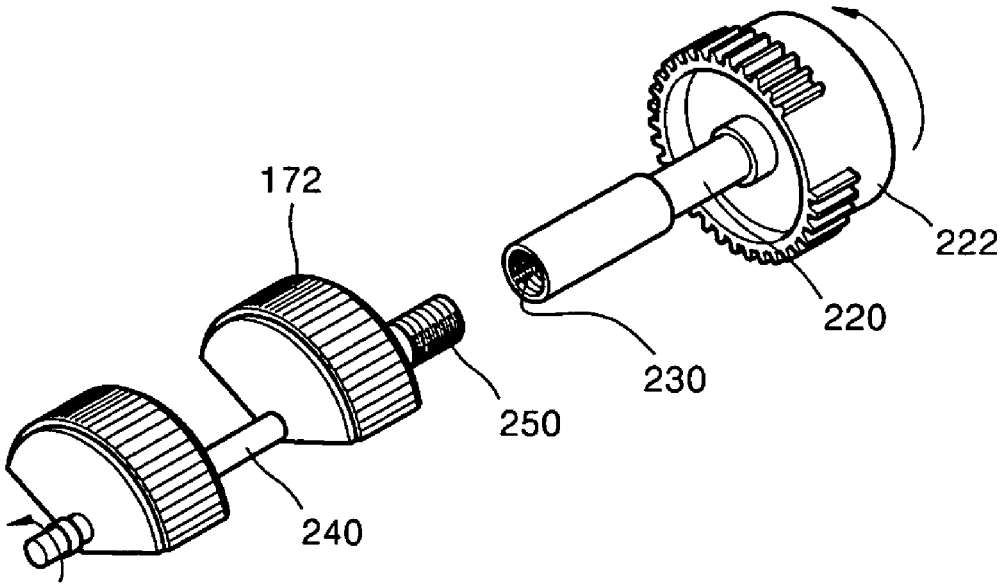
FIG. 21 is a perspective view illustrating the state in which the paper pickup device shown in FIG. 20 is separated from the image forming apparatus.
Figure 22:
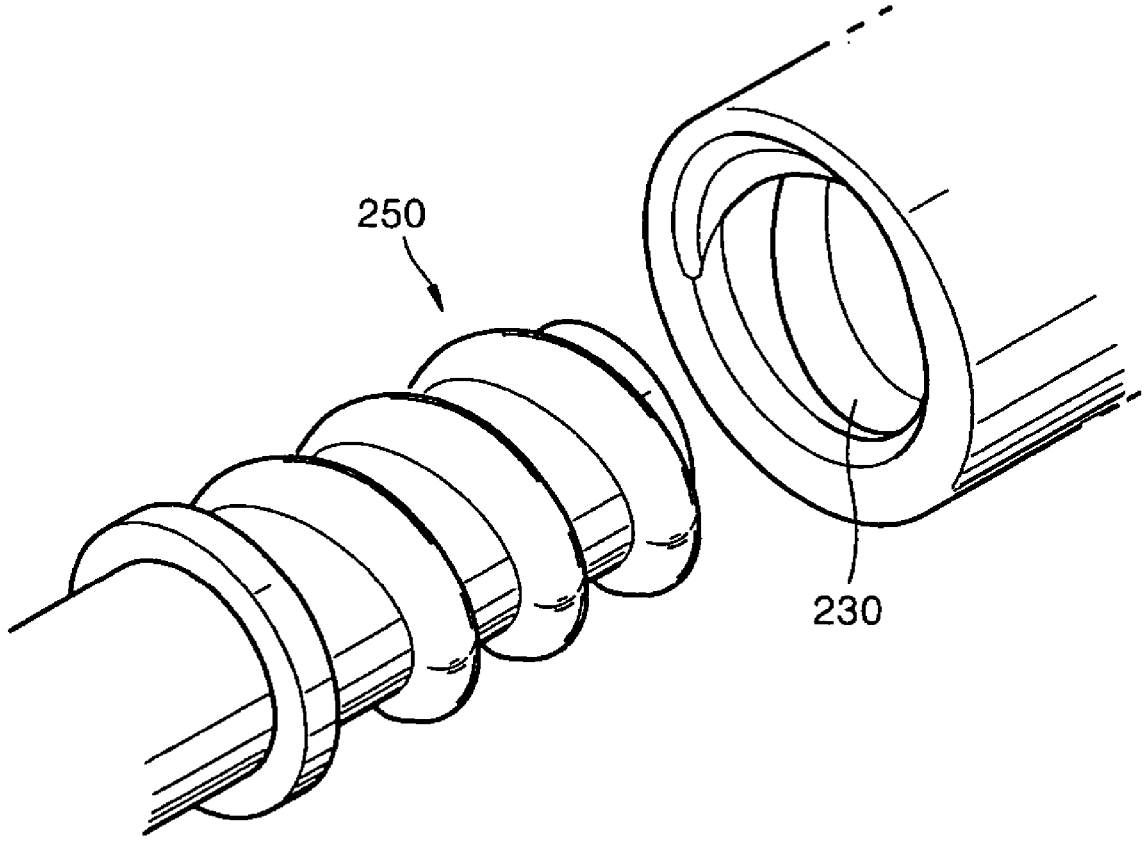
FIG. 22 is a perspective view illustrating the state in which the first combining portion and the second combining portion are separated from each other.

FIG. 20 is a perspective view of a paper pickup device according to another embodiment of the present invention. FIG. 21 is a perspective view illustrating the state in which the paper pickup device is separated from the image forming apparatus. FIG. 22 is a perspective view illustrating the state in which the first combining portion and the second combining portion are separated from each other.

Referring to FIGS. 20-22, the first combining portion 230 and the second combining portion 250 may be screw-coupled to each other. In addition, the second combining portion 250 may be combined with the first combining portion 230 while rotating in the reverse direction as a direction in which the pickup roller 172 is rotated. When the second combining portion 250 is combined with the first combining portion 230 in the direction in which the pickup roller 172 is rotated, even though the pickup roller 172 installed on the driven shaft 240 during a printing operation is rotated, the first combining portion 230 and the second combining portion 250 are prevented from being separated from each other.

Referring to FIG. 22, the first combining portion 230 may be a female screw, and the second combining portion 250 may be a male screw. In addition, the first combining portion 230 may be a male screw and the second combining portion 250 may be a female screw.

If the pickup roller 172 is used more than a predetermined number of times, the surface thereof is worn and a frictional force thereof is lost and thus should be replaced with another one. In order to replace the pickup roller 172, the driven shaft 240 should be separated from the driving shaft 220. By rotating the driven shaft 240 in a direction opposite to a rotational direction when the driven shaft 240 is combined with the driving shaft 220, the driven shaft 240 can be separated from the driving shaft 220.

The structure of the pickup roller 172 for improving a pickup performance of the pickup roller 172 is the same as the above-described embodiment and thus, a detailed description thereof will be omitted for purposes of clarity and conciseness.

With the above structure, the pickup roller 172 is prevented from vibrating during a printing operation. Therefore, paper feeding performance of the sheet of paper S using the pickup roller 172 can be comparatively improved.

As described above, in the paper pickup device and the image forming apparatus having the same according to embodiments of the present invention, the driven shaft on which the pickup roller is installed bends and separates from the driving shaft or the driven shaft and the driving shaft are screw-coupled to each other so that the driven shaft can be easily replaced. In addition, vibration is prevented from occurring when the driven shaft is combined with the driving shaft. In addition, since the number of components such as a connection sleeve and an elastic member for releasing compression is reduced so that manufacturing costs can be effectively reduced.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A paper pickup device for an image forming apparatus, the paper pickup device comprising:

a frame;

a driving shaft being configured to connect with a driving unit of the image forming apparatus and rotatably installed on the frame for movement in a predetermined direction, the driving shaft having an end with a first combining portion; and a driven shaft having a pickup roller to feed paper being installed thereon, the driven shaft having an end with a second combining portion configured to connect with the first combining portion;

wherein the first combining portion and the second combining portion have a complementary configuration so that any one combining portion is inserted and combined with the remaining combining portion;

a protrusion is formed on an outer circumference of the inserted combining portion;

a combining groove is formed in a lengthwise direction of the remaining combining portion into which the protrusion is inserted; and an opening that opens in the lengthwise direction of the remaining combining portion to face the combining groove is formed in the remaining combining portion, the opening comprising a tapered inclined surface formed opposite the combining groove, and the tapered inclined surface being inclined toward an end of the combining portion;

wherein when the first combining portion and the second combining portion are connected with each other, to disconnect the driving shaft and the driven shaft, the second combining portion is first radially pivoted to the inclined surface to be substantially perpendicular to the lengthwise direction of the second combining portion, and then separated from the first combining portion.

2. The device of claim 1, further comprising a holder installed on the frame to support the driven shaft so that the driven shaft is inserted into the holder and freely rotated.

3. The device of claim 2, wherein the combining groove and the inclined surface are formed in the first combining portion.

4. The device of claim 2, wherein the combining groove and the inclined surface are formed in the second combining portion.

5. A paper pickup device for an image forming apparatus, the paper pickup device comprising:

a frame;

a driving shaft being configured to connect with a driving unit of the image forming apparatus and rotatably installed on the frame for movement in a predetermined direction, the driving shaft having an end with a first combining portion;

a driven shaft having a pickup roller to feed paper being installed thereon, the driven shaft having an end with a second combining portion configured to connect with the first combining portion; and a hole is formed on a surface of pickup roller that contacts paper, the hole having an inner diameter which is increased when pressed by a thickness of paper;

wherein the first combining portion and the second combining portion have a complementary configuration so that any one combining portion is inserted and combined with the remaining combining portion;

a protrusion is formed on an outer circumference of the inserted combining portion;

a combining groove is formed in a lengthwise direction of the remaining combining portion into which the protrusion is inserted; and an opening that opens in the lengthwise direction of the remaining combining portion to face the combining groove is formed in the remaining combining portion, the opening comprising a tapered inclined surface formed opposite the combining groove, and the tapered inclined surface being inclined toward an end of the combining portion;

wherein when the first combining portion and the second combining portion are connected with each other, to disconnect the driving shaft and the driven shaft, the second combining portion is first radially pivoted to the inclined surface to be substantially perpendicular to the lengthwise direction of the second combining portion, and then separated from the first combining portion.

6. The device of claim 5, wherein the hole extends toward the rotational center of the pickup roller.

7. The device of claim 5, wherein the surface of the pickup roller that contacts paper is formed of a material having a Poisson's ratio of about 0.1 to 0.49.

8. The device of claim 5, wherein the surface of the pickup roller that contacts paper is formed of EPDM.

9. A paper pickup device for an image forming apparatus, the paper pickup device comprising:

a frame;

a driving shaft being connected to a driving unit of the image forming apparatus and rotatably installed on the frame for movement in a predetermined direction, the driving shaft having an end with a first combining portion; and a driven shaft on which a pickup roller for feeding paper is installed, the driven shaft having an end with a second combining portion configured to connect with the first combining portion;

wherein the first combining portion and the second combining portion are screw-coupled to each other; and the second combining portion is combined with the first combining portion while rotating in the reverse direction with respect to a direction in which the pickup roller is rotated.

10. The device of claim 9, wherein one of the first combining portion and the second combining portion is a female screw and the other thereof is a male screw.

11. The device of claim 10, wherein the first combining portion is a female screw and the second combining portion is a male screw.

12. A paper pickup device for an image forming apparatus, the paper pickup device comprising:

a frame;

a driving shaft being connected to a driving unit of the image forming apparatus and rotatably installed on the frame for movement in a predetermined direction, the driving shaft having an end with a first combining portion;

a driven shaft on which a pickup roller for feeding paper is installed, the driven shaft having an end with a second combining portion configured to connect with the first combining portion; and a hole is formed on a surface of the pickup roller that contacts the paper, the hole having an inner diameter which increases when being pressed by a thickness of paper;

wherein the first combining portion and the second combining portion are screw-coupled to each other; and the second combining portion is combined with the first combining portion while rotating in the reverse direction with respect to a direction in which the pickup roller is rotated.

13. The device of claim 12, wherein the hole extends toward a rotational center of the pickup roller.

14. The device of claim 12, wherein the surface of the pickup roller that contacts paper is formed of a material having a Poisson's ratio of about 0.1 to 0.49.

15. An image forming apparatus having a paper pickup device feeding paper, the paper pickup device comprising:

a frame;

a driving shaft being connected to a driving unit of the image forming apparatus and rotatably installed on the frame for movement in a predetermined direction, the driving shaft having an end with a first combining portion; and a driven shaft on which a pickup roller for feeding paper is installed, the driven shaft having an end with a second combining portion configured to be integrally connected with the first combining portion, wherein the first combining portion and the second combining portion have a complementary configuration so that any one combining portion is inserted and combined with the remaining combining portion;

a protrusion is formed on an outer circumference of the inserted combining portion;

a combining groove is formed in a lengthwise direction of the remaining combining portion into which the protrusion is inserted; and an opening that opens in the lengthwise direction of the remaining combining portion to face the combining groove is formed in the remaining combining portion, the opening comprising a tapered inclined surface formed opposite the combining groove, and the tapered inclined surface being inclined toward an end of the combining portion;

wherein when the first combining portion and the second combining portion are connected with each other, to disconnect the driving shaft and the driven shaft, the second combining portion is first radially pivoted to the inclined surface to be substantially perpendicular to the lengthwise direction of the second combining portion, and then separated from the first combining portion.

16. The image forming apparatus of claim 15, wherein the first combining portion and the second combining portion have a complementary configuration so that any one combining portion is inserted and combined with the remaining combining portion;

a protrusion is formed on an outer circumference of the inserted combining portion;

a combining groove being formed in a lengthwise direction of the remaining combining portion and into which the protrusion is inserted; and an opening being opened in the lengthwise direction of the remaining combining portion to face the combining groove is formed in the remaining combining portion.

17. The image forming apparatus of claim 16, further comprising a holder installed on the frame to support the driven shaft so that the driven shaft is inserted into the holder and freely rotatable.

18. The image forming apparatus of claim 17, wherein a hole is formed on a surface of the pickup roller that contacts paper, the hole has an inner diameter which increases when being pressed by a thickness of paper.

19. An image forming apparatus having a paper pickup device feeding paper, the paper pickup device comprising:

a frame;

a driving shaft being connected to a driving unit of the image forming apparatus and rotatably installed on the frame for movement in a predetermined direction, the driving shaft having an end with a first combining portion; and a driven shaft on which a pickup roller for feeding paper is installed, the driven shaft having an end with a second combining portion configured to be integrally connected with the first combining portion, wherein the first combining portion and the second combining portion are screw-coupled to each other; and the second combining portion is combined with the first combining portion while rotating in the reverse direction with respect to a direction in which the pickup roller is rotated.

20. The image forming apparatus of claim 19, wherein a hole is formed on a surface of the pickup roller that contacts paper, the hole has an inner diameter which increases when being pressed by a thickness of paper.

21. A paper pickup device for an image forming apparatus, the paper pickup device comprising:

a frame;

a driving shaft being connected to a driving unit of the image forming apparatus and rotatably installed on the frame for movement in a predetermined direction, the driving shaft having an end with a first combining portion; and a driven shaft on which a pickup roller for feeding paper is installed, the driven shaft having an end with a second combining portion configured to connect with the first combining portion;

wherein the first combining portion and the second combining portion are screw-coupled to each other; and one of the first and second combining portions is a female screw and the remaining one of the first and second combining portions is a male screw.

* * * * *